United States Patent [19]

Delage

[11] Patent Number: 4,719,877

[45] Date of Patent: Jan. 19, 1988

[54] FUEL PREHEATER

[76] Inventor: Richard A. Delage, 82 May St., Biddeford, Me. 04005

[21] Appl. No.: 933,174

[22] Filed: Nov. 21, 1986

[51] Int. Cl.[4] ..... F22B 5/00

[52] U.S. Cl. ..... 122/14; 431/210; 431/275

[58] Field of Search ..... 431/210, 215, 11; 122/20 A, 20 B, 10, 18, 19, 14

[56] References Cited

U.S. PATENT DOCUMENTS

| | | | |
|---|---|---|---|
| 1,806,390 | 5/1931 | Farr et al. | 122/10 |
| 2,707,989 | 5/1955 | Schori | 431/210 X |
| 4,008,041 | 2/1977 | Roffe et al. | 431/210 X |
| 4,013,396 | 3/1977 | Tenney | 431/11 |

*Primary Examiner*—Edward G. Favors

[57] ABSTRACT

A fuel preheater for use on a boiler fired by an oil burner of the type using an oil pump pumping oil from a tank, the boiler being of the type having a supply line carrying a heated medium from the boiler, the preheater having a coil member wrapped around the supply line of the boiler, a supply pipe extending from the oil burner pump outlet to the top of the coil to direct oil pumped from the tank through the pump and up to and through the coil where the oil is heated by its close proximity to the heated medium in the supply line; and a feed line extending from the base of the coil to receive fuel once it has passed through the coil and been heated which feed line extends to and is interconnected to the oil burner where the preheated oil is burned.

7 Claims, 1 Drawing Figure

FUEL PREHEATER

BACKGROUND OF THE INVENTION

1. Field of the Invention

The device of this invention resides in the area of fuel preheaters and more particularly relates to a fuel preheater that receives its heat source indirectly from the fuel being burned.

2. Description of the Prior Art

Fuel preheaters are well known in the prior art. They reduce the viscosity of fuel and increase the efficiency of the burning thereof so that an oil burner having a fuel preheater operates more economically and efficiently. Fuel preheaters of the prior art often have an external power source such as electricity to powerr an electric heater to heat the fuel before it is passed to the burner nozzle. Other prior art systems pass the fuel in pipes through tanks which contain heated water directed from the boiler to increase the temperature of the fuel before it enters the oil burner for burning.

SUMMARY OF THE INVENTION

It is an object of this invention to provide an improved fuel preheater which is simple in construction and efficient and which eliminates a problem of the prior art which in some cases ran preheated oil through the pump of the oil burner. This invention also eliminates water jacket sludge buildup, a problem found found in prior art fuel preheaters having coiled pipes running through water jackets through which coiled pipes the fuel is pumped before it is burned.

The fuel preheater of this invention includes a fuel-carrying pipe coiled around the supply pipe of the typical boiler. As the boiler operates, the supply pipe heats up and heats the fuel which passes through the coil therearound. The fuel is introduced to the coil from a pipe that is added between the oil burner pump and the top of the coil while at the base of the coil another pipe directs the heated fuel to the oil burner nozzle where it is burned. The coil can have clamps at the top and bottom to hold it in position and can have thermal grease packed therearound to increase the heat conductivity from the supply pipe to the coil. Fireproof-type insulation such as a fiber glass mat or equivalent can be wrapped around the coil. The advantages of the fuel preheater as described herein is that there is absolutely no maintenance required once it has been set up. There are no electrical or moving parts and no casings with water passing therethrough to clog up with sludge as in the prior art. The system of this invention is a passive system. The oil passing through the coil has been found to heat to a temperature between 125 degrees F. and 140 degrees F. If one desires warmer oil, one can increase the number of coils around the supply line. If one desires a lower oil temperature, one can decrease the number of coils. It is expected that the fuel savings will quickly pay for the installation of the heating coil of this invention whether it is supplied as part of a new original installation or as an aftermarket kit to be installed on pre-existing boilers and oil burners. As mentioned above, with this invention no heated oil passes through the pump and therefore extra wear on the pump caused by heat in the oil is eliminated by this invention.

The coil of this invention can be provided made of copper. Many different grades of fuel from number 1–6 can be used with the coil of this invention. A savings of between 10–25% in fuel consumption can be expected when utilizing this system. The stack temperature when utilizing preheated fuel can rise between 50–100 degrees F. Therefore a smaller nozzle size to handle the heated fuel which has lower viscosity can be utilized. Such a smaller nozzle allows less fuel to be burned in its normal operation. Further the warmth in the supply line remains even when the burner is shut off so that the fuel is of lower viscosity and easier and faster to ignite when the oil burner starts. This faster ignition eliminates the typical wasted fuel that is encountered in the starting of oil burners that run by pumping cold fuel for a period of time before combustion occurs efficiently. As mentioned above, the unit of this invention can be sold as a kit that can be assembled on existing burners. The coil as sold in kit form can be installed on the supply line and can, in one embodiment the coil of 0.25 inch tubing can have an inside diameter of 1.5 inches and extend as a coil approximately 9.5 feet in length wrapped around the supply line. Other diameters of tubing can be utilized as the supply line varies in size from boiler to boiler. When using fuel of higher viscosity, wider diameter tubing can be used in the coils. The tubing can be wrapped 16–17 times around the supply line to form the coil for an average installation using #1 or #2 fuel oil. When using heavier oils, more wrappings may be necessary for longer tube contact with the heated supply line to transfer more heat to such heavier oil.

DESCRIPTION OF THE PREFERRED EMBODIMENT(S)

Figure 1:
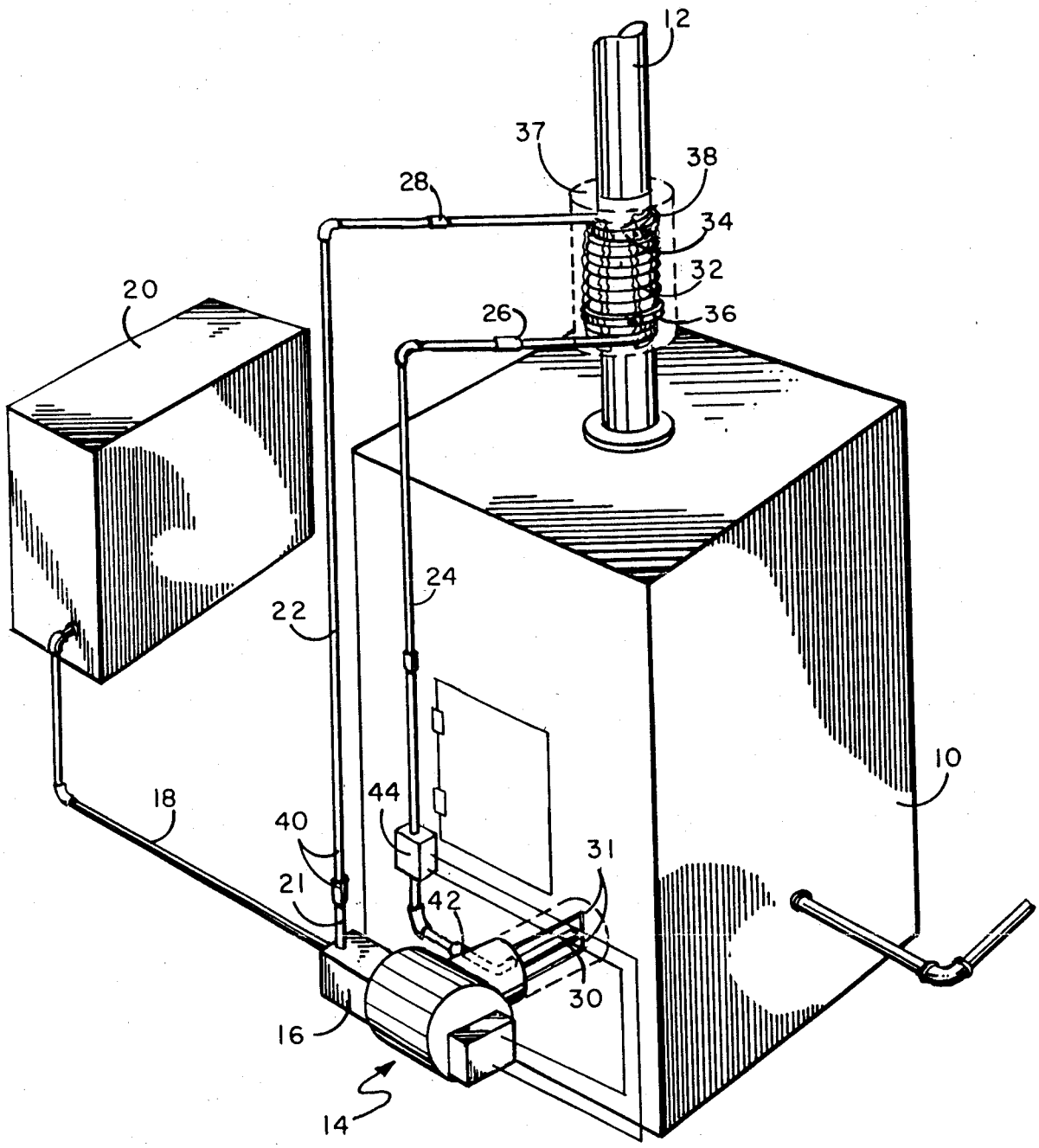
FIG. 1 illustrates a perspective view of the apparatus of this invention installed on a boiler which is heated by an oil burner.

FIG. 1 illustrates typical boiler 10 having oil burner 14 mounted therein with a typical water feed pipe and supply pipe line 12 which extends to whatever heat radiation means is to be utilized in the system whether it be hot water, steam or the like. Supply pipe line 12 commonly extends from the top of boiler 10 and such supply pipe lines are found in the majority of oil-fired boilers. The system of this invention utilizes existing oil burner 14 which receives the fuel from tank 20 through fuel line 18 into oil burner pump 16. The fuel then passes from outlet line 21 of pump 16 on which line 21 is mounted reducing nut 42 for the preheater supply line to be interconnected thereto causing pump 14 to pump the fuel up preheater supply line 22 to where the preheater supply line is interconnected by quarter inch union 26 to the top of coil 32 which is a pipe coiled around supply line 12. Clamp 34 can be affixed to the top of the coil to hold it securely to supply line 12. Coil 32 extends around supply line 12 the desired number of times and second clamp 36 can be at the base thereof to hold the bottom of the coil in place. At this point, the oil having been pumped through preheater supply line 22 and passing around hot supply line 12 in coil 32, picks up the heat from supply line 12 through coil 32 and increases in temperature from between 50–70 degrees F. as it comes from tank 20 to an after-heating temperature of approximately 125–140 degrees F. in feed line 24 extending from the base of coil 32. A union 28 can be used to interconnect feed line 24 to the base of coil 32, and feed line 24 can extend downward to reducing nut 42 where it is interconnected to the supply feed of oil burner nozzle 30 seen in this view extending above electrodes 31 so that when the oil burner starts, the fuel coming out of nozzle 30 has been preheated and is ignited by electrode 31 for burning in boiler 10. Delayed oil valve 44 can be a solenoid valve on feed line 24 to delay the oil flow to the nozzle for 4–5 seconds before it opens and allows the oil to reach the nozzle for burning. This delay allows the firing chamber to be cleared out with the oil burner blower running. The stoppage of oil flow at delayed oil valve 44 at the end of a cycle of burner operation prevents oil from expanding down feed line 24 and passing into and through nozzle 30 when the burner is not operating. Valve 44 acts as a safety device to prevent oil from flowing from the coil into the firing chamber when the burner is off. Valve 44 is wired to the oil burner so that it is opened when the oil burner runs with a slight delay and closes when the oil burner shuts off.

As mentioned, the device of this invention can be provided in a kit form with the coil as one member, supply and feed lines, and fittings supplied for installation on existing oil burners and boilers for domestic or commercial use.

After coil 32 has been installed around supply line 12, thermal grease 38 can be packed therearound which increases the heat conductivity from supply line 12 to the coiled pipe of coil 32 so that heat is transferred directly and efficiently from the supply line to the coil. Insulation can be wrapped around the coil after installation such as fiber glass mat insulation 37 or other equivalent suitable flame-resistant insulative materials which are well known for the insulative wrapping of pipe members and the like.

In practice to install the kit of this invention, one first can take the stack temperature and perform $CO_2$ tests before installation so that proper determinations can be made of what size the nozzle should be after installation. It is expected that the size of the nozzle of the oil burner will be reduced by at least 20% after installation of this kit. One would drain the boiler and remove the supply line from the top. One then installs the coil by slipping it onto the supply line. In some embodiments, though, the coil would be made by wrapping a pipe around the supply line. One then installs quarter-inch union nuts on the inlet of the top portion of the coil and another on the outlet at the bottom of the coil allowing for sufficient room to attach supply line 22 and feed line 24 thereto respectively. One can pack thermal grease 38 around the installation and install first clamp 34 at the top and second clamp 36 at the bottom to hold the coil securely in place on the supply line. The preheater should be around 6 inches above the point where the supply line is tapped to the boiler. One can then wrap insulation, such as a fiber glass wrap or equivalent, if desired around the entire preheater structure. The insulation wrap can be held in place around the preheater using tie-on or duct tape to secure it. One then can locate high pressure outlet line 21 on pump 16 and cut into pipe line 21 and install reducing nuts on both sides of that line. One would then take supply line 22 and install it between nut 40 and union 26 so that when pump 16 is activated, fuel will be drawn from tank 20 through line 18 and up through supply line 22 into coil 32 and around in the coil where it is heated and then out the base of the coil at union 28. From union 28 a feed line 24 is provided in the kit which extends from the union 28 down to the burner assembly where it interconnects to burner nozzle 30 where, once the pump runs, the nozzle sprays the preheated fuel which is ignited by electrodes 31 in the normal course of operation. One should be careful to test the system and purge out any air before starting the system. The burner pressure should be at approximately 100 psi and one should allow, when one starts operation, for the boiler temperature to reach 150 degrees F. At this point another efficiency test should be performed and if the stack temperature exceeds 600 degrees F., the nozzle size should be reduced another 5%. In the preferred embodiment, the stack temperature should be between 525–575 degrees F.

The coil of this invention can be constructed of copper tubing. The systems extraordinary simplicity allows for maintenance-free operation in that once it is installed, it should require no care to maintain the fuel preheater system in operation.

Although the present invention has been described with reference to particular embodiments, it will be apparent to those skilled in the art that variations and modifications can be substituted therefor without departing from the principles and spirit of the invention.

I claim:

1. In combination with an oil burner having a nozzle for atomizing fuel fed to it under high pressure for burning in a boiler of the type having a supply line for carrying a heated medium therefrom and a pump for feeding the fuel from a reservoir at the desired high pressure to said nozzle, means for preheating said fuel comprising a coil member wrapped around said line in heat transfer engagement therewith, a fuel supply line extending from the outlet of said pump to one end of said coil member to direct pressurized fuel from the outlet of said pump through said coil member to be heated by heat transfer from said supply line;

a fuel feed line connecting the other end of said coil member to said nozzle for feeding pressurized preheated fuel thereto, and thermal grease packed around said coil member to help conduct the heat from said heated medium in said supply line to said coil to preheat the fuel in said coil before it is burned.

2. The device of claim 1 further including:

a first clamp located at the top of said coil member to help hold it in position;

a second clamp located at the base of said coil member to help hold it in position; and insulative wrap wraped around said coil member with means to hold said wrap in position to help retain heat around said coil member.

3. The device of claim 2 further including a delayed oil valve on said feed line adapted to open when said oil burner operates and to close when said oil burner shuts off.

4. A kit for use on a boiler fired by an oil burner of the type using an oil pump pumping oil from a tank, said boiler being of the type having a supply line carrying a heated medium from said boiler, comprising:

a pipe member to form a coil around said supply line of said boiler;

a supply pipe for interconnection between said oil burner pump's outlet and the top of said coil;

thermal grease to pack around said coil once it is in position on said supply line;

a feed line to extend from the base of said coil to direct heated fuel back to the nozzle of said oil burner; and a delayed oil valve for installation on said feed line adapted to receive power from said oil burner to open said feed line when said oil burner operates and to closed said feed line when said burner shuts off.

5. The kit of claim 4 further including:

insulative wrap to apply around said coil.

6. The kit of claim 5 further including:

four unions to interconnect said supply pipe to said oil burner's pump outlet, the top of said coil, and said supply pipe from the end of the pump outlet extending to the burner nozzle.

7. In combination with an oil burner having a nozzle for atomizing fuel fed to it under high pressure for burning in a boiler of the type having a supply line for carrying a heated medium therefrom and a pump for feeding the fuel from a reservoir at the desired high pressure to said nozzle, means for preheating said fuel comprising a coil member wrapped around said line in heat transfer engagement therewith, a fuel supply line extending from the outlet of said pump to one end of said coil member to direct pressurized fuel from the outlet of said pump through said coil member to be heated by heat transfer from said supply line; and a fuel feed line connecting the other end of said coil member to said nozzle for feeding pressurized preheated fuel thereto.

* * * * *